United States Patent [19]

Taipale et al.

[11] Patent Number: 4,982,766

[45] Date of Patent: Jan. 8, 1991

[54] PAPER MACHINE FABRIC

[75] Inventors: Seppo Taipale, Siilinjärvi; Merja Hakkarainen, Juankoski, both of Finland

[73] Assignee: Tamfelt Oy Ab, Tampere, Finland

[21] Appl. No.: 514,447

[22] Filed: Apr. 25, 1990

[30] Foreign Application Priority Data

Mar. 2, 1990 [FI] Finland ..... 901090

[51] Int. Cl.[5] ..... D03D 23/00

[52] U.S. Cl. ..... 139/383 A; 162/DIG. 1; 162/358; 428/225; 428/257

[58] Field of Search ..... 139/383 A; 162/358, 162/DIG. 1; 428/225, 257

[56] References Cited

FOREIGN PATENT DOCUMENTS 823830 5/1983 Finland .
873506 1/1987 Finland .
872079 5/1987 Finland .

*Primary Examiner*—James J. Bell

*Attorney, Agent, or Firm*—Lowe, Price, LeBlanc, Becker & Shur

[57] ABSTRACT

A two-layer paper machine fabric comprising a machine direction yarn system and two cross-machine direction yarn systems, the systems being interlaced in accordance with a 16-shaft weave repeat. To achieve a fabric having advantageous wear properties, the lower cross-machine direction yarn forms floats spanning 13 yarns on the underside of the fabric and is interwoven in the fabric by passing it during one weave repeat over two machine direction yarns positioned close to each other in such a way that at least one machine direction yarn remains between said two machine direction yarns, said at least one machine direction yarn passing over the lower cross-machine direction yarn. The upper cross-machine direction paper-contacting yarn forms floats of shorter span as compared with the lower cross-machine direction yarn on the upper side of the fabric and is interlaced with at least two machine direction yarns per weave repeat.

6 Claims, 3 Drawing Sheets

FIG. 1
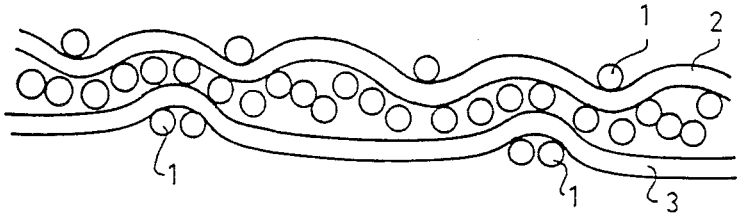
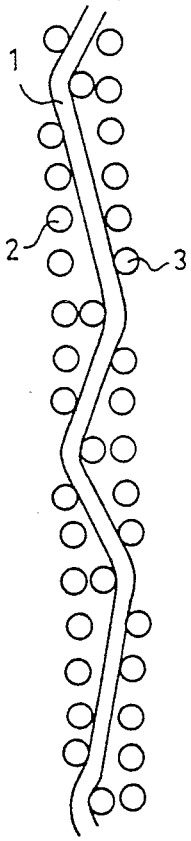
FIG. 2
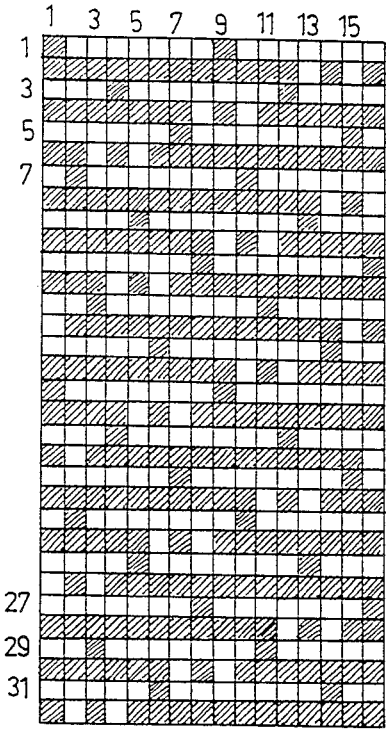
FIG. 3

FIG. 4
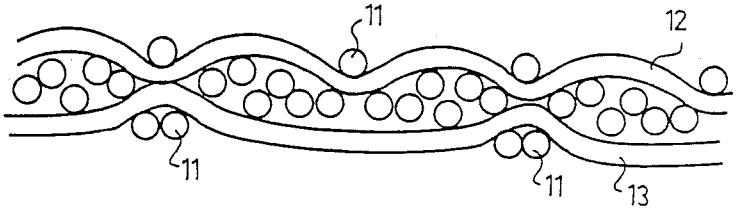
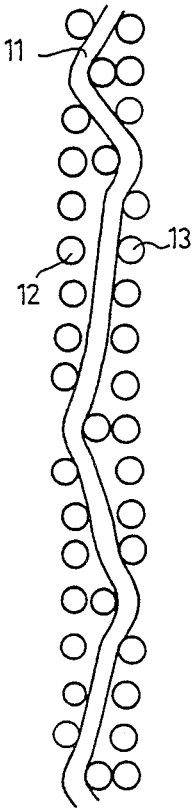
FIG. 5
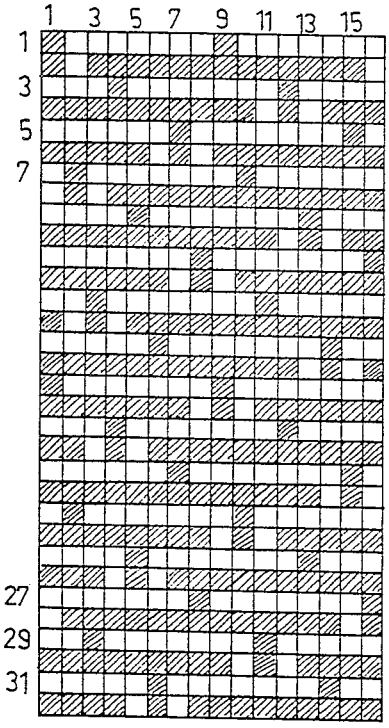
FIG. 6

FIG. 7
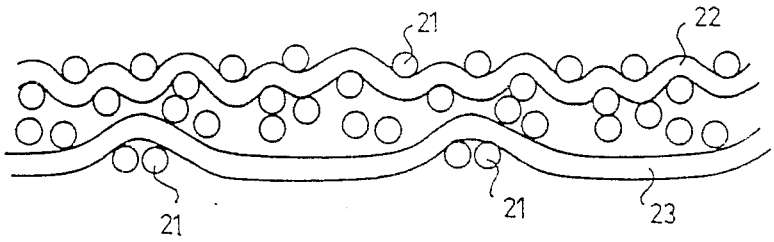
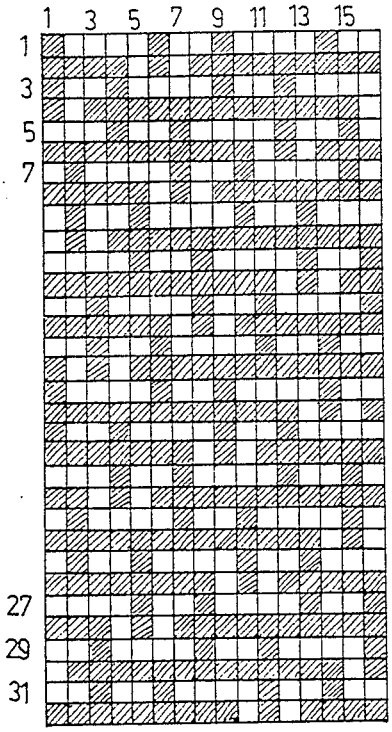
FIG. 9
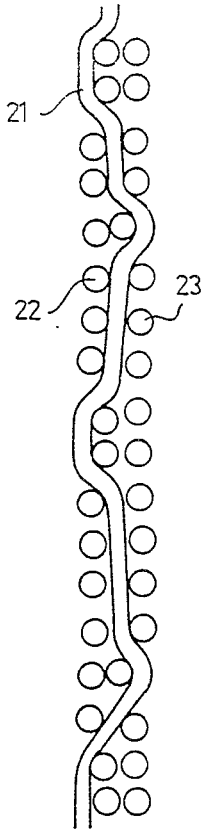
FIG. 8

PAPER MACHINE FABRIC

The invention relates to a two-layer paper machine fabric comprising a machine direction yarn system and two cross-machine direction yarn systems, the systems being interlaced in accordance with a 16-shaft weave repeat.

Several paper machine fabrics of this type are known in the art, including those disclosed in FI patent applications Ser. No. 823830, 872079 and 873506. These prior art solutions aim at long useful life by providing long floats of cross-machine direction yarns in the lower surface, that is, in the surface making contact with the rolls of the paper machine, in addition to which the cross-machine direction yarns on the underside consist of very thick yarns which curve in a direction away from the surface of the wire. In all cases, the object has been to prevent the wear of the machine direction yarns.

A drawback of the solution of FI patent application Ser. No. 823830 is, however, that the upper knuckle of the thick lower yarn penetrates into the upper layer beside the cross-machine direction yarns to form part of the forming surface, thus deteriorating its smoothness. Also, the weave of the lower yarn causes diagonal streak formation, which easily becomes visible on the surface, if the lower-yarn is thick. A further drawback with the forming wire is that the thick lower yarn causes marking in the dewatering process because of the large hollows extending straight from the top surface towards the bottom surface of the wire, which deteriorates the smoothness of the paper.

A drawback of the wire of FI patent application Ser. No. 873506 is the uneven weave. In this solution the machine direction yarns pass in parallel over three pairs of yarn between the pairs of yarn. In this relatively long span, $\frac{3}{8}$ of the length of the weave repeat, the machine direction yarns are positioned close together so that they are grouped into pairs, forming alternating closely and sparsely woven longitudinal areas. The solution of this patent application may also cause narrow diagonal streak formation on the paper-contacting side due to the grouping of the knuckles of the machine direction yarns.

FI patent applications Ser. No. 873506 and 872079 aim at a fabric in which the machine-direction yarns are better protected than previously. The thick cross-machine direction yarns on the underside of the fabric are thereby in a curved position so that the middle portion of the float is exposed to wear first. After the cross-machine direction yarns have worn off, the machine direction yarns are still undamaged. This solution does not substantially improve the wear resistance of the wire as the machine-contacting surface is small due to the curving of the yarn floats exposed to wear. The wear is rapid for a start, until the lower cross-machine direction yarns have worn to such an extent that they make contact with the machine nearly over the whole float length. At this stage, however, the middle portion of the lower cross-machine direction yarn has become so thin that it is about to break. After the lower cross-machine direction yarn has broken, the wire has worn out. It cannot be used any longer although the machine direction yarns are fully intact. Accordingly, the complete protection of the machine direction yarns is not of any particular advantage in view of the useful life of the wire.

The surface structure of both of the solutions of the above-mentioned patent applications consists of alternating longer and shorter floats of cross-machine direction yarns. Variation in the length of surface yarn floats usually causes marking problems, as it is practically impossible to get them accurately in level with each other. FI patent application Ser. No. 873506 suggests that the lower knuckles of machine direction yarns passing under the lower cross-machine direction yarn should be positioned directly under the shorter cross-machine direction yarn float. This, however, does not provide sufficiently good results as in practice the shorter float will rise higher than the longer float, which is not exposed to any external forces.

The object of the invention is to provide a paper machine fabric by means of which the drawbacks of the prior art can be avoided. This is achieved by means of a paper machine fabric of the invention which is characterized in that the lower cross-machine direction yarn forms floats spanning 13 yarns on the underside of the fabric and is interwoven in the fabric by passing it during one weave repeat over two machine direction yarns positioned close to each other in such a way that at least one machine direction yarn remains between said two machine direction yarns, said at least one machine direction yarn passing over the lower cross-machine direction yarn, and that the upper cross-machine direction paper-contacting yarn forms floats of shorter span as compared with the lower cross-machine direction yarn on the upper side of the fabric and is interlaced with at least two machine direction yarns per weave repeat.

A major advantage of the invention is that it improves the wear resistance as compared with prior art solutions. This is due to the fact that the machine-contacting wear surface is very large, because the machine direction yarns are in level with the cross-machine direction yarns. This is possible because the height difference between the machine-contacting outermost planes of the machine direction and cross-machine direction yarns is such that when the lower cross-machine direction yarn has worn off, the lower knuckles of the machine direction yarn have worn at the most to such an extent that the tensile strength of the fabric is sufficient for the use of the wire. In other words, a long useful life is achieved with the large wear surface formed by the long substantially straight knuckles of the lower cross-machine direction yarns and the lower knuckles of the machine direction yarns. Difference between the outermost machine-contacting planes of the cross-machine direction yarns and the lower machine direction yarns is smaller than previously, so that the largest possible yarn volume is at once exposed to wear and at a later stage both yarn systems are exposed to wear. A further advantage is that the structure of the wire is even in view of both dewatering and surface marking. As the cross-machine direction yarns on the paper-contacting surface are in level with each other, a sufficient support surface is provided for the paper stock. Due to the even weave structure and suitable yarn size, no large vacant hollows are formed in the surface of the wire of the invention but the dewatering takes place evenly throughout the wire, and the paper will get good smoothness properties.

In the following, the invention will be described in greater detail by means of preferred embodiments shown in the attached drawing, whereby FIG. 1 illustrates one embodiment of the paper machine fabric of the invention as viewed in the direction of machine direction yarns, FIG. 2 illustrates the embodiment of FIG. 1 as viewed in the direction of cross-machine direction yarns;

FIG. 3 illustrates the weave pattern of the embodiment of FIGS. 1 and 2;

FIG. 4 illustrates another embodiment of the paper machine fabric of the invention as viewed in the direction of machine direction yarns;

FIG. 5 illustrates the embodiment of FIG. 4 as viewed in the direction of cross-machine direction yarns;

FIG. 6 illustrate the weave pattern of the embodiment of FIGS. 4 and 5;

FIG. 7 illustrates still another embodiment of the paper machine fabric of the invention as viewed in the direction of machine direction yarns;

FIG. 8 illustrates the embodiment of FIG. 7 as viewed in the direction of cross-machine direction yarns;

FIG. 9 illustrates the weave pattern of the embodiment of FIGS. 7 and 8.

FIGS. 1 to 3 show one preferred embodiment of the invention. The reference numeral 1 indicates machine direction yarns forming a machine direction yarn system. The reference numerals 2 and 3, in turn, indicate cross-machine direction yarns forming two cross-machine direction yarn systems. The machine direction and cross-machine direction yarns are interlaced in accordance with a 16-shaft weave repeat. FIG. 3 shows the weave pattern of the embodiment of FIGS. 1 and 2. A filled-in square in the weave pattern indicates that a machine direction yarn passes over a cross-machine direction yarn.

According to the basic idea of the invention, the lower cross-machine direction yarns 3 form floats spanning 13 machine direction yarns on the lower surface of the fabric. The upper cross-machine direction yarns 2 form floats on the upper surface of the fabric, that is, for instance, on the surface acting as a forming surface, which floats are shorter than the lower cross-machine direction yarns. The lower cross-machine direction yarns 3 are interlaced with two machine direction yarns 1 positioned close to each other during the weave repeat. As used herein, the expression two machine direction yarns positioned close to each other means that the cross-machine direction yarns 3 are interlaced with two machine direction yarns 1 positioned close to but not immediately adjacent to each other. In addition, the thickness of the lower cross-machine direction yarns 3 is selected so relative to the machine direction yarns 1 that if the yarns 3 are worn off in use, the breaking strength of the machine direction yarns 1 passing under them, that is, the breaking strength in the direction of length of the fabric, is more than 150 N/cm.

Drawbacks caused by previously used thick yarns with long floats on the forming side of the fabric can be eliminated by suitably selecting the thickness of the lower cross-machine direction yarns 3. One of these drawbacks is that the upper knuckles of the cross-machine direction yarns on the underside are visible on the forming side of the fabric.

By using a long-float yarn thinner than previously, floats on the underside of the fabric are substantially straight and start to wear over the length of the whole float and not only in the middle as in prior art wires with a long lower float.

With relatively small height differences between the yarn systems, the most important advantage is that the wear is retarded when the machine-contacting plane of the lower cross-machine direction yarns 3 reaches the lowest plane of the lower knuckles of the machine direction yarns 1. Retardation of wear is due to the fact that a larger yarn volume is exposed to wear, that is, the long floats of the cross-machine direction yarns 3 and the lower knuckles of the machine-direction yarns 1, one machine-direction yarn 1 comprising two lower knuckles per repeat. In this way the dewatering properties are maintained constant for a longer period of time.

If the differences between the machine-contacting planes of the machine direction and cross-machine direction yarns of the fabric are large, the cross-machine direction yarns only are worn at first. The wear rate, that is, the rate of decrease in the thickness of the fabric, is thereby higher than in cases where the lower knuckles of the machine-direction yarns are also exposed to wear. In this case it is of no use that the machine-direction yarns remain intact, as the fabric, such as a wire, cannot be used any longer after the lower cross-machine direction yarns have worn off.

As mentioned above, the thickness of the lower cross-machine direction yarns 3 is selected so that after they have worn off in a paper machine, the machine-direction yarns 1, that is, the warp yarns, have worn at the most to such an extent that the tensile strength of the fabric in the direction of its length is no more than 150 N/cm. That it to say, the large wear volume is utilized as far as possible whereas the wear rate is as low as possible.

By decreasing the wear rate, variation in the properties of the fabric, such as a wire, can be prevented during the papermaking process. When the outermost plane of the machine-contacting cross-machine direction yarns 3 is close to the outermost plane of the machine direction yarns 1 on the machine side, the wear initially takes place relatively rapidly until the outermost planes of the machine direction and the lower cross-machine direction yarn system adjoin, whereafter the wear is considerably slower because of the available great yarn volume. Final wear rate is further decreased by the use of polyamide or some other synthetic wear-resistant material in the cross-machine direction yarn system on the machine side.

The outermost machine-contacting planes of the machine direction and cross-machine direction yarns will be positioned close to each other when the type of the weft yarn and the weaving and thermal treatment process are selected suitably. The closer the outermost planes of said two yarn systems are brought to each other, the more rapidly the normal situation is achieved, in which the wear is slow and therefore variation in the properties of the wire due to wear is insignificant and takes place slowly. The higher the wear rate of the wire, the more its permeability decreases due to material displacement caused by rapid wear on the trailing side of the yarns. When the wear rate is decreased, deterioration in permeability is also decreased.

As mentioned above, the lower machine-contacting cross-machine direction yarn 3 is interwoven with two machine direction yarns 1. The two machine direction yarns 1 are not adjacent yarns in the fabric. This structure improves the stability of the fabric as compared with an otherwise similar fabric in which long-float cross-machine direction yarns are interlaced with a single machine direction yarn or with two adjacent machine direction yarns per repeat. The fabric becomes more capable of resisting diagonal biasing in particular, when long-float cross-machine direction yarns are interlaced with two machine direction yarns positioned in the fabric close to but not immediately adjacent to each other.

One or more yarns may remain between the two machine-direction yarns 1 interlacing the machine-contacting cross-machine direction yarn 3. In the embodiment of FIGS. 1 to 3, the machine-direction yarn remaining between said two machine-direction yarns 1 is arranged to pass between the upper and the lower cross-machine direction yarn 2, 3. This solution, however, is not the only possible but the yarn(s) between the machine-direction yarns interlacing the machine-contacting cross-machine direction yarn 3 may as well be positioned above the upper cross-machine direction yarn system, depending on the weave pattern used. Essential in this respect is that the machine-contacting cross-machine direction yarn is interlaced with two machine-direction yarns positioned close to each other during one repeat while the paper-contacting cross-machine direction yarn is interlaced with two or more machine-direction yarns apart from each other during one repeat.

FIGS. 4 to 6 show another preferred embodiment of the paper machine fabric of the invention. FIGS. 4 to 6 show the fabric similarly as FIGS. 1 to 3. The reference numeral 11 indicates machine direction yarns forming a machine direction yarn system. The reference numerals 12 and 13 indicate cross-machine direction yarns forming two cross-machine direction yarn systems. The yarn systems are interlaced with each other similarly as described above in connection with FIGS. 1 to 3. FIG. 6 illustrates the weave pattern.

The embodiment of FIGS. 4 to 6 corresponds to that of FIGS. 1 to 3 in most respects. The only difference is that, in the embodiment of FIGS. 4 to 6, the machine direction yarn positioned between the two machine direction yarns 11 interlacing the lower cross-machine direction yarn 13 is arranged to pass over the upper cross-machine direction yarn 12 at this point.

FIGS. 7 to 9 show still another embodiment of the paper machine fabric of the invention. The reference numeral 21 indicates machine direction yarns forming a machine direction yarn system. The reference numerals 22 and 23 indicate cross-machine direction yarns forming two cross-machine direction yarn systems. The yarn systems are interlaced with each other similarly as described above in connection with the FIGS. 1 to 3 and 4 to 6. The embodiment of FIGS. 7 to 9 differs from that of FIGS. 4 to 6 in that the upper cross-machine direction yarn 22 is interlaced with more machine direction yarns apart from each other than the yarn 12 in the embodiment of FIGS. 4 to 6.

The embodiments described above are not in any way intended to limit the invention, but the invention can be modified within the scope of the claims as desired. For example, the invention is not limited to any specific yarn material but any suitable yarn can be used.

We claim:

1. A two-layer paper machine fabric comprising a machine direction yarn system and two cross-machine direction yarn systems, the systems being interlaced in accordance with a 16-shaft weave repeat, wherein the lower cross-machine direction yarn forms floats spanning 13 yarns on the underside of the fabric and is interwoven in the fabric by passing it during one weave repeat over two machine direction yarns positioned close to each other in such a way that at least one machine direction yarn remains between said two machine direction yarns, said at least one machine direction yarn passing over the lower cross-machine direction yarn, and that the upper cross-machine direction paper-contacting yarn forms floats of shorter span as compared with the lower cross-machine direction yarn on the upper side of the fabric and is interlaced with at least two machine direction yarns per weave repeat.

2. A paper machine fabric according to claim 1, wherein the machine direction yarn passing over the lower cross-machine direction yarn and remaining between the two machine direction yarns, over which the lower cross-machine direction yarn passes, is arranged to pass between the upper and the lower cross-machine direction yarn at this point.

3. A paper machine fabric according to claim 1, wherein the machine direction yarn passing over the lower cross-machine direction yarn and remaining between the two machine direction yarns passes, over which the lower cross-machine direction yarn, is arranged to pass over the upper cross-machine direction yarn at this point.

4. A paper machine fabric according to claim 1, wherein the machine direction yarn remaining between the two machine direction yarns, over which the lower cross-machine direction yarn passes, is adjacent to at least one of said machine direction yarns.

5. A paper machine fabric according to claim 1, wherein the machine direction yarn remaining between the two machine direction yarns, over which the lower cross-machine direction yarn passes, is adjacent to both of said two machine direction yarns.

6. A paper machine fabric according to claim 1 wherein the thickness of the lower cross-machine direction yarn is selected so that if the yarn wears off, the breaking strength of the fabric in the direction of its length is more than 150 N/cm.

* * * * *